US005131555A

United States Patent [19]

DeMars et al.

[11] Patent Number: 5,131,555

[45] Date of Patent: Jul. 21, 1992

[54] BEVERAGE CONTAINER OPENING TOP

[76] Inventors: Robert A. DeMars, 23221 Ladrillo Ave., Woodland Hills, Calif. 91367; Spencer L. Mackay, 28765 Pisces St., Agoura Hills, Calif. 91301

[21] Appl. No.: 790,520

[22] Filed: Nov. 12, 1991

[51] Int. Cl.[5] ..... B65D 17/34

[52] U.S. Cl. ..... 220/269

[58] Field of Search ..... 220/269, 270, 271, 272, 220/273, 276

[56] References Cited

U.S. PATENT DOCUMENTS 3,250,425 5/1966 Stec et al. ..... 220/273

4,951,835 8/1990 DeMars et al. ..... 220/269

*Primary Examiner*—Stephen Marcus

*Assistant Examiner*—Nova Stucker

*Attorney, Agent, or Firm*—Jack C. Munro

[57] ABSTRACT

A top for a beverage container which includes a handle which is pivotally mounted on the top between a stowage position and a frangible seal breaking position. A camming arrangement is incorporated on the top which functions to locate the handle in a canted position within the frangible seal breaking position so as to facilitate the movement of the handle to frangibly separate a breakaway tab incorporated within the top. The locating of the handle in the canted position can be accomplished by use of a proturberance mounted on the top with the handle to be moved over to ride on the protuberance or can be accomplished by means of a protuberance mounted on the handle which rides within an arcuate slot formed within the top.

8 Claims, 2 Drawing Sheets

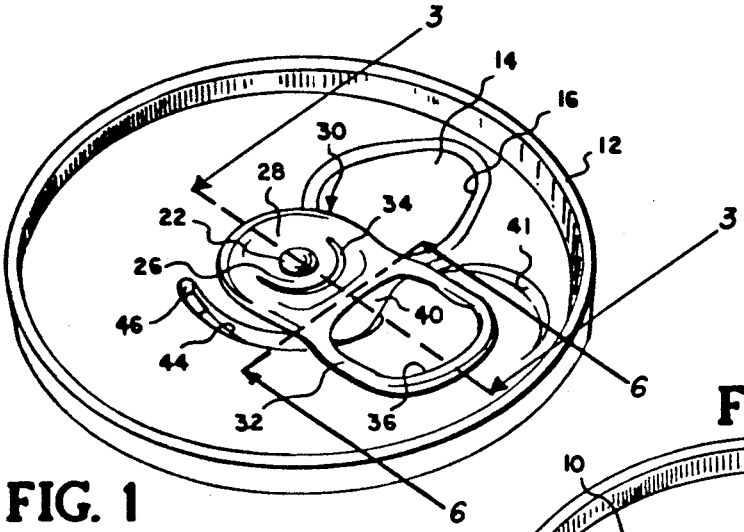
FIG. 1
FIG. 2
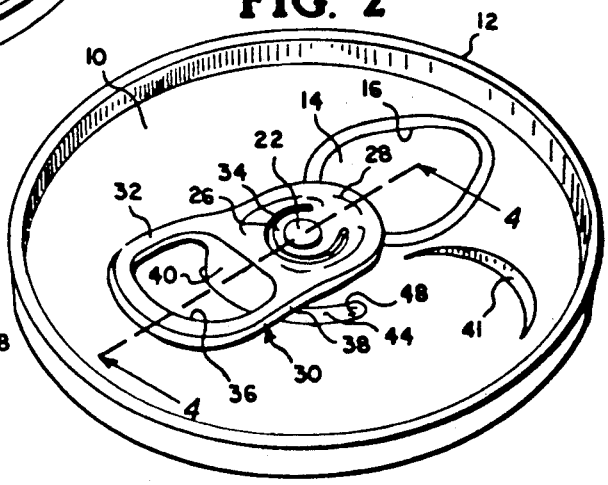
FIG. 3
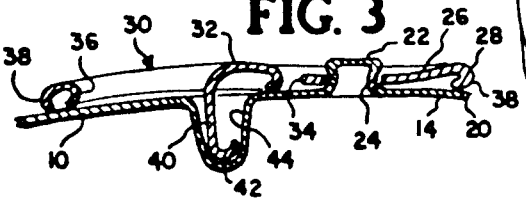
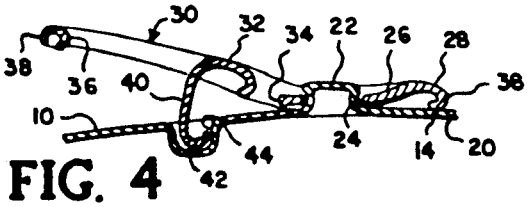
FIG. 4
FIG. 6
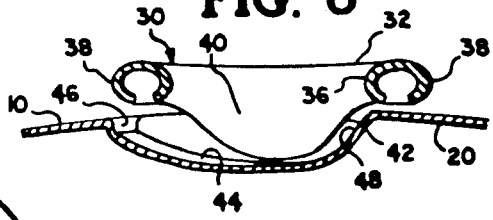
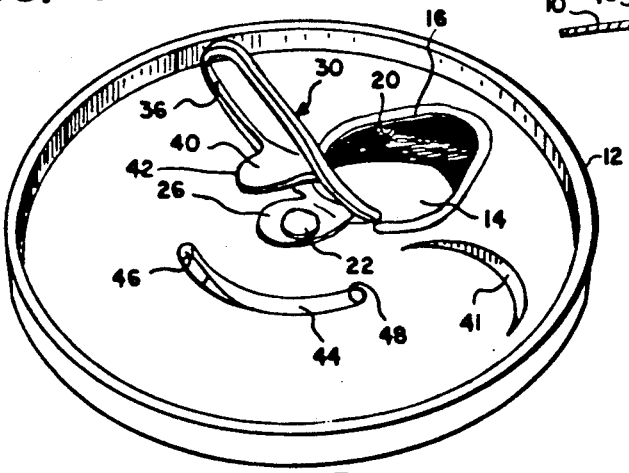
FIG. 5

FIG. 7
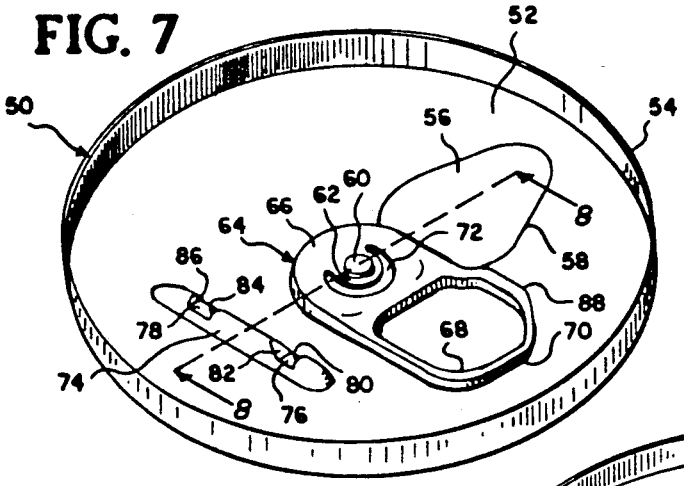
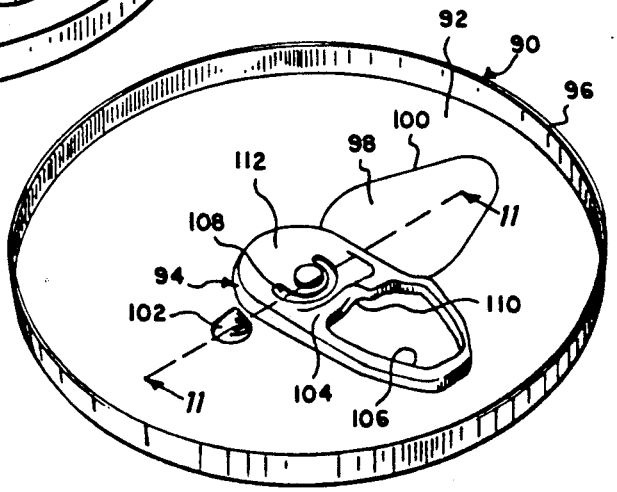
FIG. 10
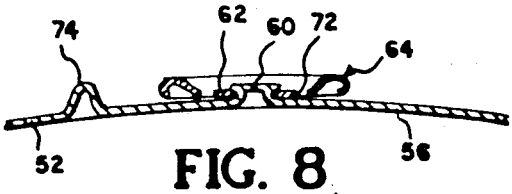
FIG. 8
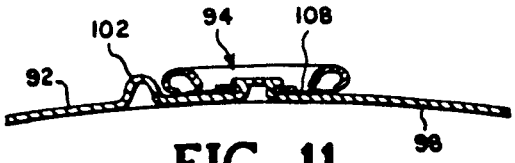
FIG. 11
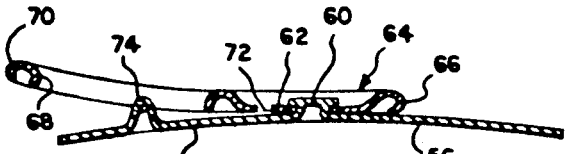
FIG. 9
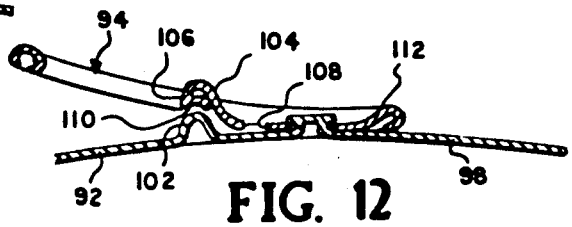
FIG. 12

BEVERAGE CONTAINER OPENING TOP

BACKGROUND OF THE INVENTION

1) FIELD OF THE INVENTION

The field of this invention relates to beverage cans and more particularly to an aluminum type of beverage can which has integrally incorporated within the top an opening device which frangibly separates a tab from the remaining portion of the top thereby producing an opening through which the contents of the beverage can is to be removed.

2) DESCRIPTION OF PRIOR ART

Billions of aluminum cans are produced annually for the packaging of beer, soda and other beverages. It is common that these cans include a frangible tab within the top of the can. Associated with the frangible tab is a pivotable handle. The handle is to be pivoted by the user to cause breakage of the frangible seal between the tab and the top of the can and cause the tab to deflect inward to the interior of the can exposing an aperture through which the contents of the beverage can now be dispensed.

These types of beverage cans include a handle with this handle being mounted flush against the top. The physical size of the top results in the free outer end of the handle being located directly adjacent the edge of the top It is difficult for most human beings to use one's hand to initiate the upward and outward pivoting movement of the handle from its flush position against the top so that the handle can be moved to affect frangible breaking of the tab from the remaining portion of the top. Women commonly use their fingernails which results in nails being broken and men who generally do not have much of a fingernail, find it difficult to get the handle initially moved so that sufficient access is provided between the handle and the top so that the handle can then be moved further to affect the frangible separating of the tab from the top.

In the past, tools have been designed which are to engage the handle so that the handle can be initially moved to position which makes it easy for one to move the handle the remaining distance to frangibly separate the tab from the remaining portion of the top of the beverage container. However, these tools require an additional piece of equipment that must be carried by an individual and if forgotten by the individual, no tool is available.

In the past, opening mechanisms for the tops of beverage containers have been designed to be movable to position to facilitate their operation without the use of any tool. Reference is to be had to U.S. Pat. No. 4,951,835, invented by Robert A. DeMars et al., in which such a type of beverage container opening device is described. Also, reference is to be had to U.S. Pat. No. 3,250,425, invented by F. J. Stec et al. in which another such opening device is clearly described. However, the problems with the opening devices of the prior art is that they have not included any structure which has clearly indicated to the user when the handle is in the correct position for breaking of the frangible seal between the tab and the top. Also, there has not been included any structure which facilitates the manual movement of the handle from the stowage position to the frangible seal breaking position. Further, there has not been included any structure within the top which tends to maintain the handle in the stowage position to prevent unauthorized movement of the handle away from the stowage position during transporting of the beverage container to the ultimate consumer.

SUMMARY OF THE INVENTION

A top for a beverage container which includes a frangible seal breaking handle which is to be pivotable from a stowage position to a frangible seal breaking position with a frangible seal between a tab and the top to be broken in order to dispense the contents of the beverage container. The handle is to be moved across a camming protuberance which will cause the handle to be raised to a canted position relative to the top therefore facilitating manual connection of a finger of a user with the handle to facilitate movement to break the frangible seal between the tab and the remaining portion of the top. Between the camming protuberance and the handle there is a detent arrangement utilized to correctly position the handle in the precise position to frangibly break the tab. The camming protuberance may be mounted on the handle, instead of the top, which is to engage with an arcuate groove formed on the top with this arcuate groove having an inclined bottom surface so that when the handle is in the correct frangible seal breaking position, the handle is raised to the canted position. The outer sidewall surface of the handle is to include an enlarged flat flange which is to facilitate connection with a user's finger to thereby facilitate movement of the handle from the stowage position to the frangible seal breaking position.

The primary objective of the present invention is to construct a frangible seal breaking device for the top of a beverage container which will precisely locate the frangible seal breaking device for the user in the precise frangible seal breaking position even if the user is blind.

Another objective of the present invention is to construct a frangible seal breaking device to be utilized in conjunction with the top of a beverage container which can be operated easily by unskilled individuals as well as individuals with physical ailments such as arthritis.

BRIEF DESCRIPTION OF THE DRAWINGS

FIG. 1 is an isometric view of a top of a typical beverage container showing the first embodiment of frangible seal breaking device of this invention showing the frangible seal breaking device in the stowage position;

FIG. 2 is a view similar to FIG. 1 but showing the frangible seal breaking device in the frangible seal breaking position;

FIG. 3 is a cross-sectional view taken along line 3—3 of FIG. 1;

FIG. 4 is a cross-sectional view taken along line 4—4 of FIG. 2;

FIG. 5 is a view similar to FIG. 2 but showing the handle at the upper extent of its movement which accomplishes the breaking of the frangible seal between the tab and the top;

FIG. 6 is a cross-sectional view taken along line 6—6 of FIG. 1;

FIG. 7 is an isometric view of second embodiment of frangible seal breaking device mounted in conjunction with the top of the beverage container showing the handle of this device being located in the stowage position;

FIG. 8 is a cross-sectional view taken along line 8—8 of FIG. 7;

FIG. 9 is a cross-sectional view taken in the same direction as FIG. 8 but with the handle in the frangible seal breaking position rather than the stowage position;

FIG. 10 is a view similar to FIG. 7 of a third embodiment of this invention;

FIG. 11 is a cross-sectional view taken along line 11—11 of FIG. 10 showing the handle in the stowage position; and FIG. 12 is a view similar to FIG. 11 but showing the handle in the frangible seal breaking position.

DETAILED DESCRIPTION OF THE SHOWN EMBODIMENT

Referring particularly to the drawings there is shown a top for a beverage container which is defined generally as a planar, circular, thin, rigid, top 10 which at its periphery has an upstanding, circular, bead flange 12. Typical material construction for the top 10 will be aluminum. The flange 12 is to form a seam with the sidewall (not shown) of the beverage container (not shown). It is to be understood that the beverage container will include an internal compartment within which is to be located a quantity of a liquid beverage.

Within the top 10 there is located a tab 14. This tab is connected by a frangible seal 16 to top 10. Sufficient amount of physical pressure being applied to the upper (exterior) surface of the tab 14 will result in the frangible seal 16 breaking which will permit the tab 14 to be pivoted within the internal compartment 20 of the beverage container as is clearly shown within FIG. 5 of the drawings.

Centrally formed within the top 10 is a protruding post 22. This protruding post 22 is integral with the top 10. The protruding post 22 engages with a pivot hole 24 which is formed within peninsula member 26. Peninsula member 26 is integrally connected to the lever 28 of handle 30. Located between the operating end 32 of the handle 30 and the peninsula member 26 is an arcuate slot 34. The operating end 32 includes an enlarged finger opening 36. Surrounding the entire handle 30 is a depending sidewall 38. This sidewall 38 supplies overall rigidity to the handle 30 which is necessary because it is constructed of quite thin aluminum. Also the finger opening 36 has a depending sidewall with the section of this sidewall that is located nearest the protruding post 22 being enlarged to form a cam foot 40. This cam foot 40 has a smoothly contoured bottom surface 42 which functions as a camming surface. Referring to FIG. 6 it can be seen that the construction of the cam foot 40 is more bulbuous toward the right side of the handle 30.

Also formed within the top 10 is a finger accommodating depression 41. It is the function of the depression 41 to permit a finger of a human being to be located therein and apply pressure against the sidewall 38 of the operating end 32 to effect a ninety degree pivoting motion of the handle 30 about the protrusion 22. This ninety degree pivoting motion is depicted clearly when observing in comparison FIG. 1 and FIG. 2. During this pivoting motion the cam foot 40 rides within arcuate slot 44 which is also formed within the top 10. The bottom surface 42 rides along the variable depth of the slot 44 with this depth being shallowest when the handle 30 is in the frangible seal breaking position shown in FIG. 2. The depth is at maximum depth when the handle 30 is in the stowage position as shown in FIG. 1.

When in the stowage position shown in FIG. 1, the handle 30 is located substantially flush against the top 10. With the handle 30 in the frangible seal breaking position shown in FIG. 2, the handle 30 is located approximately thirty degrees inclined relative to the top 10 as is clearly shown in FIG. 4. The cam foot 40 is to abut against end wall 46 which informs the user that the handle 30 is in the precise frangible seal breaking position so that when the handle 30 is pivoted upwardly and outwardly, as is shown in FIG. 5, the lever 28 will apply physical pressure against the tab 14 affecting breaking of the frangible seal 20 and pivoting of the tab 14 within the internal chamber 20. The slot 44 also terminates in an end wall 48 which functions as a stop to define the position of the handle 30 when in the stowage position.

Referring particularly to FIGS. 7, 8 and 9 of the drawings there is shown the second embodiment 50 of beverage container top which includes a top 52 which is similar to top 10 which has a circular upstanding flange 54 located at the periphery of the top 52. Formed within the top 52 is a tab 56 which is connected by a frangible seal 58 to the top 52. The top includes a protruding post 60 which is centrally mounted within the top 52. Pivotally mounted on the post 60 is a peninsula member 62. The peninsula member 62 is integrally connected to the lever 66 which is located at the forward end of the handle 64. The aft end of the handle 64 is formed into an enlarged finger opening 68 which is enclosed by a side wall 70. Separating the peninsula member 62 in the aft end of the handle 64 is an arcuate slot 72. The slot 72 permits deflection to occur between the peninsula member 62 and the lever 66 when the lever is pivotally moved into contact with the tab 56 to effect breaking of the frangible seal 58.

Also, integrally formed on the top 52 is an elongated protrusion 74. Protrusion 74 includes a pair of spaced apart indentations 76 and 78. Indentation 76 has an outer vertical wall 80 and an inner inclined wall 82. Indentation 78 has a pair of spaced apart vertical walls 84 and 86.

A portion of the side wall 70 that is located furthest from the protrusion 74 includes an enlarged flattened section 88. This enlarged flattened section 88 is to facilitate connection with a finger of a human being which is to apply pressure tending to pivot the handle 64 toward protrusion 74. As side wall 70 comes into contact with the protrusion 74, the side wall 70 rides up onto the upper surface of the protrusion 74 with the side wall 70 first engaging with the indentation 76. Further pivoting movement of the handle 64 results in this side wall then sliding up inclined surface 82 across the center section of the protrusion 74 and come to rest within indentation 78. The vertical walls 84 and 86 confine this portion of the side wall 70 tending to resist disengagement from the protrusion 74. At this time also the portion of the side wall has enlarged flattened area 88 engages with indentation 76. Outward movement of the side wall 70 from indentation 76 is prevented by means of vertical wall 80.

The indentations 76 and 78 have correctly aligned the handle 64 in a precise centered position relative to the tab 56. The handle 64 is also located in the canted position caused by the height of the protuberance 74. As a result it is easy for a finger of a human being to be located under the aftmost edge of the side wall 70 so as to permit raising of the handle 64 which will cause the lever 66 to be pushed into the tab 56 and affect breaking of the frangible seal 58.

Referring particularly to FIGS. 10 to 12 of the drawings there is shown the third embodiment 90 of this invention which is again composed of a top 92, a handle 94 with a circular bead 96 being located around the periphery of the top 92. Formed within the top 92 is a tab 98 with a frangible seal 100 separating the tab 98 from the top 92. The handle section 94 is basically similar to handle section 64 and reference is to be had to the foregoing description. Instead of the elongated protrusion 74, there is utilized circular protrusion 102 integrally formed within the top 92. The location of the protrusion 102 is that when the handle section 94 is pivoted from the stowage position to the frangible seal breaking position, the protrusion 102 will engage with separating wall 104 which is located between the finger opening 106 and the arcuate slot 108. This is contrary to the second embodiment where the protrusion 74 engages with the area of the enlarged finger opening 68.

Within the separating wall 104 there is located a indentation 110. The protrusion 102 is to be located within the indentation 110 which functions again to precisely locate the handle 94 in the frangible seal breaking position so that the lever 112 of the handle 94 can be pushed against the tab 98 to effect breaking of the frangible seal 100. Also, with the protrusion 102 engaging with the indentation 110, the handle 94 is located in a canted position as is clearly shown in FIG. 12 which again facilitates manual movement of the handle 94 to affect breaking of the frangible seal 100.

What is claimed is:

1. A top for a beverage container, said top being constructed of a thin-walled rigid material, an aperture formed in said top, a tab normally closing said aperture, a frangible seal integrally connecting said top and said tab, an opening mechanism mounted on said top, said opening mechanism for causing breaking of said frangible seal and moving of said tab to a displaced position causing opening of said aperture, said opening mechanism including a handle integrally connected with a lever, said lever to press against said tab causing breaking of said frangible seal, a pivot hole located between said lever and said handle, a pivot pin engaging said pivot hole, said pivot pin being mounted on said top, a camming protuberance mounted on said top, said pivot pin being located directly between said camming protuberance and said aperture, said handle being pivotally movable about said pivot pin between a stowage position and a frangible seal breaking position when said frangible seal is to be broken, said handle being substantially flush against said top when in said stowage position, when said handle is in said frangible seal breaking position said handle assumes a canted position relative to said top to thereby facilitate manual connection with said handle and moving of said handle into contact with said tab and breaking of said frangible seal resulting in said tab being moved to said displaced position, an improvement comprising:

said handle having a finger opening, said finger opening having a sidewall, said camming protuberance having a first indentation, said first indentation to engage with said sidewall when said handle is positioned in said frangible seal breaking position thereby indicating to the user when said handle is in said frangible seal breaking position.

2. The top as defined in claim 1 wherein:

said camming protuberance including a second indentation with both said first and second indentation to engage with said sidewall of said finger opening.

3. The top as defined in claim 2 wherein:

said camming protuberance including an inclined surface, said inclined surface connecting with one of said indentations and being located between said indentations, said inclined surface to permit sliding of movement of said handle between said indentations.

4. The top as defined in claim 1 wherein:

a locating protuberance mounted on said top, said locating protuberance being spaced from said camming protuberance, said locating protuberance to connect with said figure opening when said handle is in said stowage position, said locating protuberance functioning to tend to maintain said handle in said stowage position and prevent inadvertent movement of said handle from said stowage position.

5. The top as defined in claim 1 wherein:

said sidewall having a portion of its exterior surface formed into a flattened enlarged flange, said flattened enlarged flange being located furthest from said camming protuberance when said handle is in said stowage position, said flattened enlarged flange facilitating manual connection with a finger of a user to facilitate movement of said handle from said stowage position to said frangible seal breaking position.

6. A top for a beverage container, said top being constructed of a thin-walled rigid material, an aperture formed in said top, a tab normally closing said aperture, a frangible seal interconnecting said top and said tab integrally connecting said top and said tab, an opening mechanism mounted on said top, said opening mechanism for causing breaking of said frangible seal and moving of said tab to a displaced position causing opening of said aperture, said opening mechanism including a handle integrally connected with a lever, said lever to press against said tab causing breaking of said frangible seal, a pivot hole located between said lever and said handle, a pivot pin engaging said pivot hole, said pivot pin being mounted on said top, said handle being pivotally movable about said pivot pin between a stowage position and a frangible seal breaking position when said frangible seal is to be broken, said handle being substantially flush against the top when in said stowage position, an improvement comprising:

an arcuate groove formed in said top, said arcuate groove having an inclined bottom surface varying the depth of said groove between a maximum depth and a shallow depth; and a camming protuberance mounted on said handle, said camming protuberance engaging with said groove, said camming protruberance being located at said maximum depth when said handle is in said stowage position, said camming protuberance being located at said shallow depth when said handle is in said frangible seal breaking position which causes said handle to be raised relative to said top assuming a canted position.

7. The top as defined in claim 6 wherein:

said groove terminating in vertical end walls with each said end wall functioning as a stop for said camming protuberance, with said camming protuberance in connection with one of said end walls said handle is in said stowage position and with said camming protuberance located against the other of said end walls said handle is in said frangible seal breaking position.

8. A top for a beverage container, said top being constructed of a thin-walled rigid material, an aperture formed in said top, a tab normally closing said aperture, a frangible seal integrally connecting said top and said tab, an opening mechanism mounted on said top, said opening mechanism for causing breaking of said frangible seal and moving of said tab to a displaced position causing opening of said aperture, said opening mechanism including a handle integrally connected with a lever, said lever to press against said tab causing breaking of said frangible seal, a pivot hole located between said lever and said handle, a pivot pin engaging said pivot hole, said pivot pin being mounted on said top, a camming protuberance mounted on said top, said pivot pin being located directly between said camming protuberance and said aperture, said handle being pivotally movable about said pivot pin between a stowage position and a frangible seal breaking position when said frangible seal is to be broken, said handle being substantially flush against said top when in said stowage position, when said handle is in said frangible seal breaking position said handle assumes a canted position relative to said top to thereby facilitate manual connection with said handle and moving of said handle into contact with said tab and breaking of said frangible seal resulting in said tab being moved to said displaced position, an improvement comprising:

said handle having an indentation, when said handle is in said frangible seal breaking position said camming protuberance engages with said indentation to correctly position said handle for movement to break said frangible seal.

* * * * *